US008516972B2

(12) United States Patent
Waldhauser et al.

(10) Patent No.: US 8,516,972 B2
(45) Date of Patent: Aug. 27, 2013

(54) PROFILE SAIL BOOM FOR SAIL BOATS

(76) Inventors: Kurt Waldhauser, Vasoldberg (AT); Volker Waldhauser, Gratkorn (AT)

( * ) Notice: Subject to any disclaimer, the term of this patent is extended or adjusted under 35 U.S.C. 154(b) by 189 days.

(21) Appl. No.: 13/256,408

(22) PCT Filed: Feb. 3, 2009

(86) PCT No.: PCT/AT2009/000041

§ 371 (c)(1),
(2), (4) Date: Sep. 13, 2011

(87) PCT Pub. No.: WO2009/097638

PCT Pub. Date: Aug. 13, 2009

(65) Prior Publication Data

US 2012/0111254 A1 May 10, 2012

(30) Foreign Application Priority Data

Feb. 6, 2008 (AT) ..... A 185/2008

(51) Int. Cl.
*B63B 15/00* (2006.01)
*B63H 9/04* (2006.01)

(52) U.S. Cl.
USPC ..... 114/97; 114/102.22; 114/102.26

(58) Field of Classification Search
USPC ..... 114/97, 98, 102.22, 102.26, 89, 102.1, 114/104, 105, 106, 107
See application file for complete search history.

(56) References Cited

U.S. PATENT DOCUMENTS

| | | | | |
|---|---|---|---|---|
| 879,986 | A * | 2/1908 | Tatchell | 114/89 |
| 3,310,017 | A | 3/1967 | Dyer | |
| 4,649,848 | A * | 3/1987 | Belvedere | 114/102.25 |
| 4,733,624 | A * | 3/1988 | Belvedere | 114/39.12 |
| 4,856,447 | A * | 8/1989 | Magnan | 114/102.25 |
| 5,065,685 | A * | 11/1991 | Stevenson, IV | 114/102.25 |
| 5,406,902 | A * | 4/1995 | Heinsohn et al. | 114/97 |
| 5,640,919 | A * | 6/1997 | Huisman | 114/106 |

FOREIGN PATENT DOCUMENTS

| | | |
|---|---|---|
| EP | 0155012 | 9/1985 |
| FR | 2472508 | 7/1981 |
| FR | 2557064 | 6/1985 |
| SU | 1512858 | 10/1989 |
| WO | WO 2009/006658 | 1/2009 |

* cited by examiner

*Primary Examiner* — Stephen Avila
(74) *Attorney, Agent, or Firm* — Greer, Burns & Crain, Ltd.

(57) ABSTRACT

The invention relates to a profile sail boom for a boat having a batten mainsail, which is configured to be flexible in the horizontal direction and has a vertical spar with cords laminated in at the uppermost and lowermost points in the center of the cross-section, transverse webs separated by wedge-shaped spacer joints extending from said spar on the lowermost site in the horizontal direction, wherein guiding tubes for cords are present on the outer edges of said webs.

5 Claims, 4 Drawing Sheets

Fig. 7
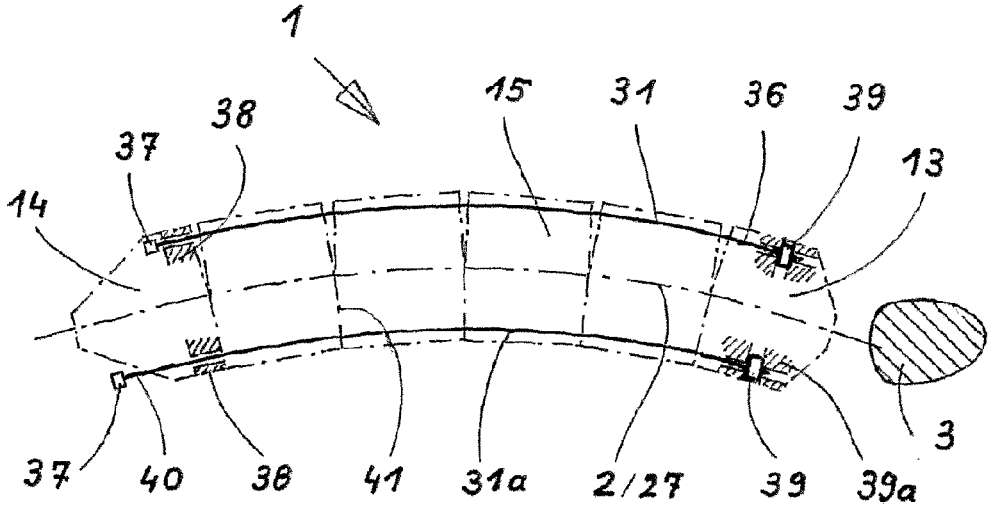
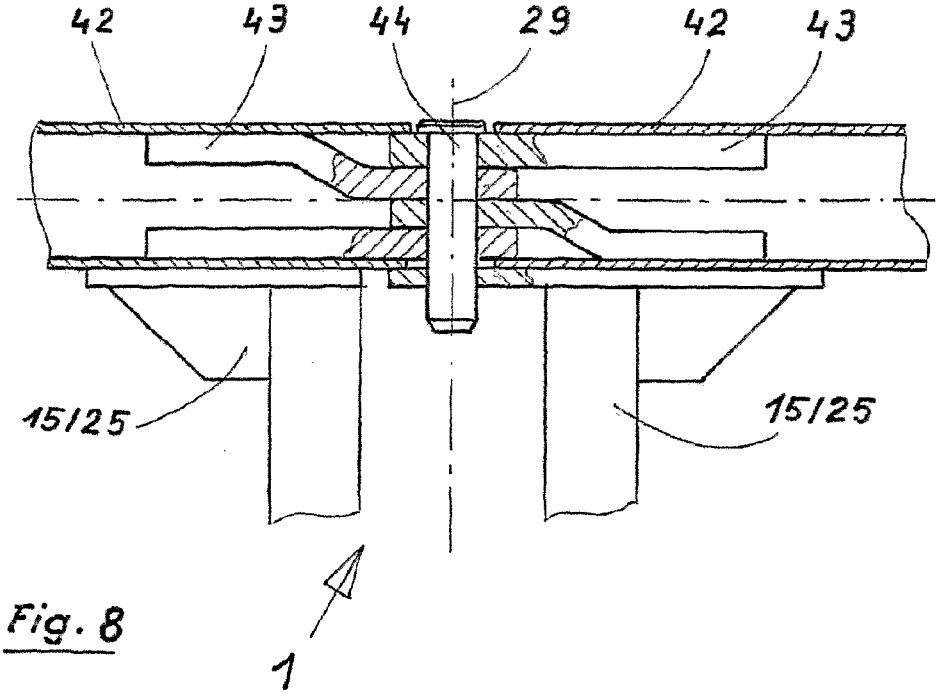
Fig. 8

PROFILE SAIL BOOM FOR SAIL BOATS

The invention relates to a horizontally flexible profile sail boom for a boat for the aerodynamic trimming of a batten mainsail, which consists in cross-section of an upright-shaped vertical spar, from which at the lowermost point transverse webs extend on both sides approximately at an angle of 90° as guide surfaces, according to the preamble of claim 1.

BACKGROUND ART

The standard sails of a conventional sailing yacht mostly consist of two sails attached to a mast located approximately midships. The triangular head sail ahead of the mast is raised or pre-hoisted along a forestay which is braced approximately from the bow to the mast tip. The clew as the free end of the leech and foot of the sail is hauled tightly by means of a jibsheet so that the sail can adopt the most favourable possible aerodynamic profiled shape to the incoming wind which produces the greatest possible drive component due to large-volume wind deflection.

The directional downdraft of this head sail is intended to energetically intensify the lee flow of the subsequently positioned mainsail in such a manner that the most extensive possible all-over wind deflection with a maximum angle of deflection can be achieved without the lee flow becoming separated from the mainsail and becoming detached to form turbulence, which means loss of propulsion.

The mainsail is pre-hoisted behind the mast by means of a usual mast guide track connected to its luff whilst the foot of the sail is held on the main boom which is mounted on the mast so that it can pivot horizontally on both sides of the mast and can be hauled tightly with a mainsheet on the boom head.

On account of the better state and efficiency, the mainsail is usually provided with a plurality of flexible and pre-tensioned sail battens which make it possible to form an aerodynamically favourable sail profile having sufficient stability along with the usual opening of the leech which affords the desired increase in the sail surface for the same mast length.

The characteristic configuration of the sail profile and its angle of attack is crucial for the specific propulsion power per $m^2$ of sail area. A great deal of technical effort is devoted primarily to the respective profile depth and its monitoring at all heights up the sail, such as sewn-in sail profiles, 3D laminates as sails and devices for controlled bending of the mast in the direction of travel. This usually takes place extremely precisely in the upper part of the sail but in the near zone of the straight boom the propulsion-bringing flow profile is increasingly deflected in a perturbing manner and ultimately interrupted by the sail boom, which is very much in the way in the direction of approach, producing turbulence.

Neither the angle of attack in the luff zone of a well-positioned main sail without edge joins, that is approximately corresponding to the incoming wind direction, nor the outflow angle at the leech following the forward-driving flow deflection inside the sail are similarly directed to the angle of attack of the boom. Thus, appreciable power losses occur in the transition zones from the sail profiled as correctly as possible in the upper region to the straight connected boom.

This is even greater since in this region the otherwise usable downdraft of the head sail does not meet an ordered lee flow on the rear side of the main sail since no such flow can be formed in this transition zone as a result of the unsatisfied requirements.

When the main sail is attached to the boom head, e.g. with a freely tensioned, therefore profilable foot of the sail, there is thus an increased possibility for the formation of wake turbulence along the foot of the sail, caused by exchange of air from the luff-side positive pressure zone to the lee side negative pressure zone. The tow turbulence thus produced and the turbulence losses of the straight boom not adapted to the direction of flow are at the expense of the drive energy and should be prevented as far as possible.

If the sail has a reef incorporated, e.g. in strong wind, and the correctly profiled sail from the upper region has become bound to the straight boom, a transition zone is also formed, whose sail area affords reduced propulsion power and due to its obliquely upwardly pitched profile, accordingly deflects the air flow upwards, which additionally leads to an elevated sail pressure point and more heeling with loss of power.

The following documents are published as prior art:

D1: U.S. Pat. No. 5,460,902 A (HEINSOHN AND MANION) 18 Apr. 1995 (18.04.1995). This describes a main boom which can adjust its shape to the sail profile; it consists of several segments. The section through this boom is rectangular.

D2: SU 1 512 858 A1 (PIVKIN AND EMELYANOV) 7 Oct. 1989 (07.10.1989) This also discloses a sail main boom consisting of several segments which are connected to one another in such a manner that the main boom can simulate the profiled shape of the mainsail. The cross-section through the boom is circular (FIG. 3).

D3: FR 2 557 064 A1 (BOISSON) 28 Jun. 1985 (28.06.1985)

This discloses a main boom comprising several segments so that its shape can be adjusted to the shape of the profile form of the mainsail. Here no inverted T-shape is provided in the cross-section.

D4: AT 504 907 B1 (WALDHAUSER KURT ING.) 15 Sep. 2008 (15.09.2008) (earlier-priority application)

This describes the cohesion of the individual sail boom segments and the control of the deflection of the sail boom by means of high-strength cord on the tension side as well as the absorption of compressive forces by means of a hard metal rocker bearings.

SUMMARY OF THE INVENTION

The invention described hereinafter is intended to avoid the aforesaid disadvantages. It is proposed to use a profile sail boom having a T-shaped cross-section, but having a transverse web extending approximately at an angle of 90° on both sides whilst the supporting strut is arranged upright in the centre. The boom according to the invention is attached to the mast in an articulated manner on all sides in the conventional manner by means of a gooseneck, held in an approximately horizontal position by means of a mast support and hauled tightly with a sheet. On the upper side of the boom the foot of the sail is held in a conventional manner, e.g. pulled in a boom groove or multiply bound by means of marlines.

The profile sail boom consists of a suitable number, e.g. six to eight or more partial pieces which are horizontally interconnected in an articulated manner, and which are arranged in a vertically flexurally stiff manner. The upright supporting central strut in a slender smooth design takes over the vertical bending stiffness of the boom and forms an additional effective sail area whilst the lower transverse web on the one hand limits or controls the horizontal bending of the partial pieces with respect to one another, on the other hand with its bilateral guide surfaces it forms that fluidic resistance in order to prevent as far as possible the undesired pressure compensation from the luff to the opposite lee side of the sail foot, which advantageously reduces the strength-sapping induced tow turbulence.

The sail required for the correct function of the main boom adaptable to the predominant streamlines has a moderately configured, incorporated sail profile approximately in the upper half in the usual manner, which is attached to the sail boom such that it becomes increasingly flatter towards the foot, ultimately becoming smooth.

The required sail profile of the sail is caused by its deflection shaping automatically produced by the wind pressure, extending far downwards from the trimmable boom. The best possible profile depth is adjusted manually and is brought to the highest possible overall efficiency in cooperation with the downdraft flow of the head sail.

Model tests with two different sail booms (bent to straight) in the air flow channel have revealed several percent more propulsion power with low heeling pressure in the comparative test. The greatest increases in performance can be achieved when sailing close-hauled as far as close to the wind. Substantial increases in performance are obtained primarily in cooperation with fluidically adapted head sails.

The mechanically necessary stiffness in the vertical plane of the sail boom according to the invention can be accomplished by suitable vertically arranged pairs of bearings between the individual partial pieces which allow a bilateral horizontal bending out with respect to one another. In order to absorb the large tensile and compressive forces which occur in a slender smooth central strut, a bearing structure comprising a plurality of lamellar-like bearing eyes is proposed, each being fixed alternately in the opposite partial piece of the profile sail boom in a force-distributing manner in the supporting structure.

In one possible embodiment, the vertically stiff cohesion is accomplished by high-strength flexible cords which run at the uppermost and lowermost position along the upright central strut of the partial pieces, connecting these and are fixed at the end pieces under pretension.

In order to absorb the pressure between the partial pieces produced by the pretension of the cods, hard-metal tipped rocker bearings are provided for force transmission, their vertical tilt axes lying in the central plane of the sail boom between the upper and lower cord, with the largest possible spacer height with respect to one another as is allowed by the structural height of the profile sail boom, Both the previously specified high-strength flexible cords and the hard-metal tipped rocker bearings are contained in the patent claims in the patent AT 504 907 B1.

A further preferred embodiment of a profile sail boom consists entirely of Faserplast which can advantageously be fabricated in a laminated piece and includes all the properties to achieve the functions according to the invention in the configured laminate structure and the special shaping of the supporting body.

The slender upright central strut is made in one piece and has respectively one high-strength flexible cord running in the longitudinal direction, laminated-in in the uppermost and lowermost region. The heightwise flat-pressed braid-like cords exhibit a cross-sectional concentration towards the top or towards the bottom in order to achieve a high bending stiffness in this vertical plane. In the horizontal plane on the other hand, the central strut according to the invention is slender in structure and the material is chosen to bend easily.

The transverse struts laminated on both sides in a suitable manner must not significantly impair this flexibility and are therefore separated into partial pieces by wedge-shaped slits at short intervals, allowing the necessary deflection with respect to one another but ultimately delimiting the permissible horizontal bending by impacting against one another.

The wedge-shaped slits open and close on every turn and must therefore be fitted with contact protection to avoid injuries. This can be achieved with tab-like covers extending over the slit or with hand-repelling overlaps let into the laminate wall.

The curve profile of the partial pieces tilted horizontally to one another is advantageously controlled by means of the transverse web overhanging at the lowermost point on both sides, which due to the tilting has enlarged spacings on the outer side of the curve compared with the tilting edge and spacings reduced by the same amount on the inner side. Controlling these spacings with respect to one another on both sides makes it possible to adjust a specific curve which can be varied as required by the boat's crew.

At each turn, the main sail, like all the other sails, goes over from one side of the boat to the other and is there re-pitched to the wind on the other bow. The profile sail boom is in this way entrained in a relatively force-free manner and on the bow, is pulled into its preset profile when the sail pressure increases and the mainsheet comes under tension.

The desired profiling of the sail boom is adjusted by cords made preferably of sheathed Faserplast of sufficient strength and flexibility which run longitudinally displaceably at the outer ends of the bilaterally projecting transverse webs, passing through this in plain bearings. On the mast-side end each cord preferably has a threaded spindle firmly connected to the transverse web which is mounted non-positively longitudinally displaceably, for example, by means of a twistable nut starting on both sides. At the other end of the cord an end terminal is fixedly attached, which finds an end stop on the yardarm-side partial piece in a guide eye in the direction of tension.

When both cords have been screwed, for example to their short length, the boom fixedly connected at the outer ends is centred and pulled straight. If both nuts are opened and the cords lengthened by the same amount, the boom can be accordingly deflected by wind pressure in both horizontal directions until one of the cords comes under tension and delimits the bending volume. The other cord on the other hand slides its excess length through the guide eye and spaces the end terminal of the cord accordingly from the end stop of the transverse web.

The manually freely adjusted slack of the control cords limits the respective pre-adjusted deflection volume of the boom but not the curve profile to be transmitted to the sail and the possible position of the maximum bending. This is automatically determined by the prevailing sail pressure of the adjacent air flow in connection with the direction and sheet tension at the boom head. A fluidically balanced deflection curve is thus established similarly to that at the head sail, which can be trimmed to a performance optimum by the direction and intensity of sheet tension.

It is therefore advantageous for the main sheet not only to use a traveller transverse to the direction of travel to be able to vary the hole point athwartships but also scope for adaptation in the longitudinal direction in order to configure the setting play of the boom so that it can be adapted to the optimal pressure relationships in the forward-driving flow deflection and can be balanced.

This can be accomplished by means of a hole point adjustment of the mainsheet on the boat in the longitudinal direction or on the main boom head, by means of an eye which is adjustable in the longitudinal direction in which the main sheet is attached. Another possibility is to attach a second main sheet in such a manner that its direction of tension is substantially more astern so that with the change in pulling intensities between the two sheet cords, their direction of tension increasingly predominates and the profile sail boom decreases in profile depth, for example, when pulled straight athwartships in accordance with the increased tension.

The above description fairly broadly reproduces the more important features of the present disclosure so that the detailed description which now follows contains additional features of the disclosure and is therefore easier to understand.

The embodiments of the disclosure are not restricted to the details of the construction which are arranged in the following description and the drawings. Other embodiments can also be implemented within the scope of the invention and executed in different ways. In addition, it is understood that the phraseology and terminology used is only used for the description and not as a restriction.

Exemplary embodiments of the invention are explained in detail with reference to the drawings.

BRIEF DESCRIPTION OF THE DRAWINGS

FIG. 7 show in plan view a deflection curve controlled by cords 27;

FIG. 8 shows a possible embodiment of a vertical rocker bearing;

BRIEF DESCRIPTION OF THE DRAWINGS

Figure 1:
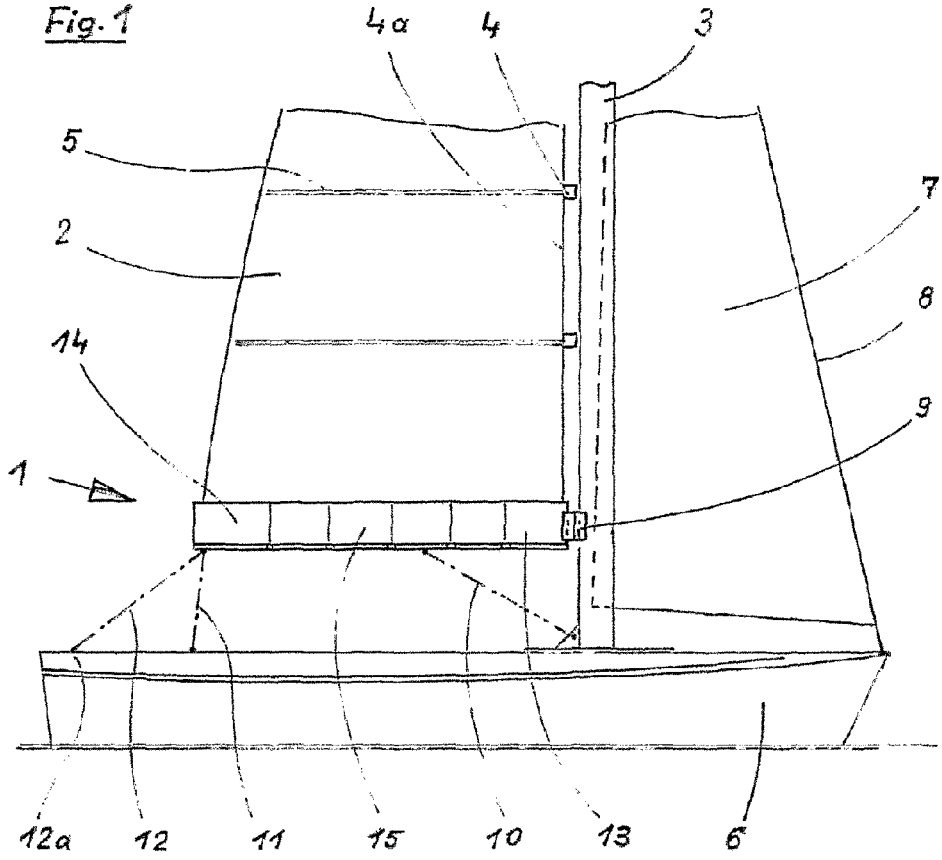
FIG. 1 shows a sail boom 1 according to the invention in side view.

FIG. 1 shows a profile sail boom 1 according to the invention in side view with a batten mainsail 2 attached thereover, which mainsail is attached to a mast 3 shown shortened by means of mast carriages 4 on the luff 4*a*, e.g. in front of sail battens 5. The mast 3 stands on a boat 6 which has set a usual head sail 7 which is attached to a forestay 8.

The profile sail boom 1 is mounted in the usual manner on the mast side with a universally movable gooseneck 9 and held approximately horizontally by means of a suitable boom support 10—(indicated by dot-dash line). A usually constricted mainsheet 11 takes over the sail tension. For trimming purposes a second main sheet 12 can advantageously be attached with athwart holepoint 12*a*. The boom consists of a mast-side partial piece 13, a yardarm side partial piece 14 and of a plurality of intermediate pieces 15 of the same type in between.

Figure 2:
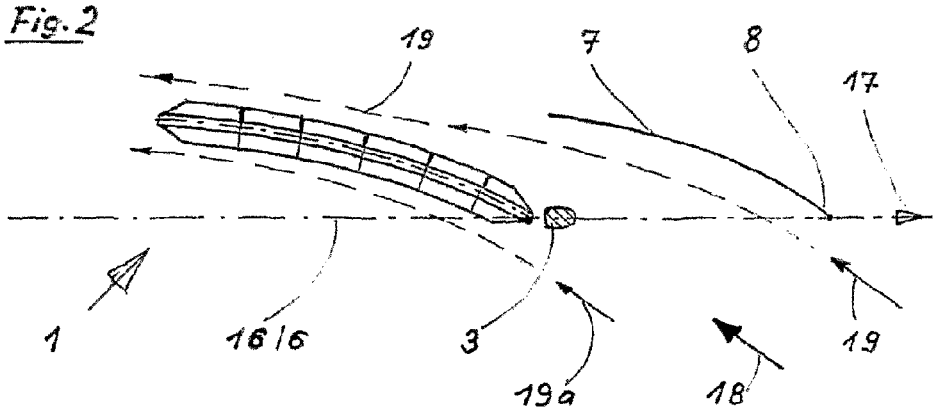
FIG. 2 shows a plan view of FIG. 1.

FIG. 2 shows a simplified plan view of the sail arrangement shown in FIG. 1. The mid line]]16 (shown by the dot-dash line) of the boat 6 (in FIG. 1) with its direction of travel 17 can be seen, a prevailing wind direction in the direction of the arrow 18, the profile sail boom 1 according to the invention in a possible deflection shape behind a cross-sectional shape of a mast 3 as well as the shape of a usual head sail 7 which is attached to the forestay 8 on the mid line 16 in a flow-deflecting manner.

The streamline 19 of the prevailing luff-side air movement approaching in the wind direction 18 is guided by the profiled head sail 7 to the lee side of the aerodynamically shaped profile sail boom 1 and there intensifies the flow energy of the adjacent lee flow without any separation to larger deflection volumes and propulsion performance, with the result that the sail region co-profiled according to the invention which is connected to the sail boom 1 towards the top can now provide full performance.

The maximum possible propulsion performance can therefore also be achieved on the luff side of the main sail 2 (in FIG. 1) by the correct deflection of the luff flow 19*a*. The lee-side air flow of the head sail 7 not shown also impacts on ordered flow relationships of the mainsail 2 (in FIG. 1) and can therefore further deflect this in larger volume without causing turbulence.

Figure 3:
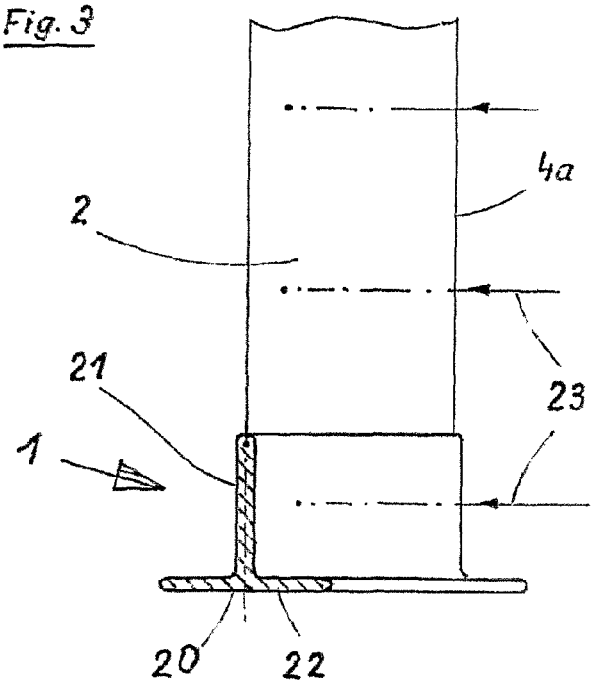
FIG. 3 shows a central section through the sail boom 1 with connected sail area.

FIG. 3 shows a section at approximately half the length through the profile sail boom 1 according to the invention viewed in the direction of the luff 4*a* of the sail 2, the luff 4*a* running at the centre of the rear edge (not shown) of the mast 3—(FIG. 1) at a suitable distance from this.

The slender upright-shaped vertically supporting strut 21 can be seen at the centre of the symmetrical cross-section shape 20 and the guide surfaces 22 extending at the lowermost point in an approximately 90° transverse position on both sides, these guide surfaces serving on the one hand to control the magnitude of the horizontal deflection and on the other hand to prevent as far as possible the harmful air exchange at the sail foot from the positive pressure zone in the luff to the lee-side negative pressure zone.

It can be seen that the sail 2 runs from the upright strut 21 of the profile sail boom 1 further upwards in the same line so that the luff- and lee-side horizontal streamlines 23 approaching via the luff 4*a* meet as directly as possible and during their propulsion-bringing horizontal deflection are as far as possible not deflected upwards which would undesirably increase the sail pressure point and lead to more heeling. The not inconsiderably-sized side surface of the upright strut 21 produces similar propulsion performance in its profiling in the flow direction as the adjoining sail region and also further improves the sail performance in this extent.

Figure 4:
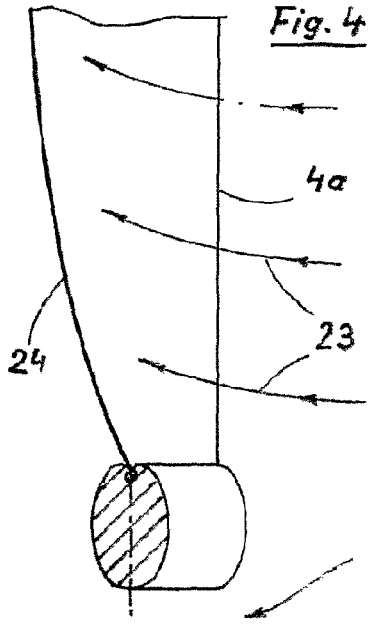
FIG. 4 shows a central section through a usual sail boom for explanation.

FIG. 4 shows a section of the same type through a sail boom of the usual design, which is straight however, also at approximately half its length and the same viewing direction for explanation. Shown as an example is a usual sail transition running obliquely upwards in a curve at the centre of a sail from a straight sail boom to the profile depth of the pushing sail profile required for the drive higher upwards such as can occur in the reefed state of the sail. The approaching horizontal streamlines 23 are in this case deflected accordingly obliquely upwards which leads to an undesired raising of the sail pressure point with more heeling and corresponding loss of performance. The side surface of the straight sail boom is approached obliquely by the wind over the entire length and produces corresponding wind resistances which brake close-to-wind courses.

Figure 5:
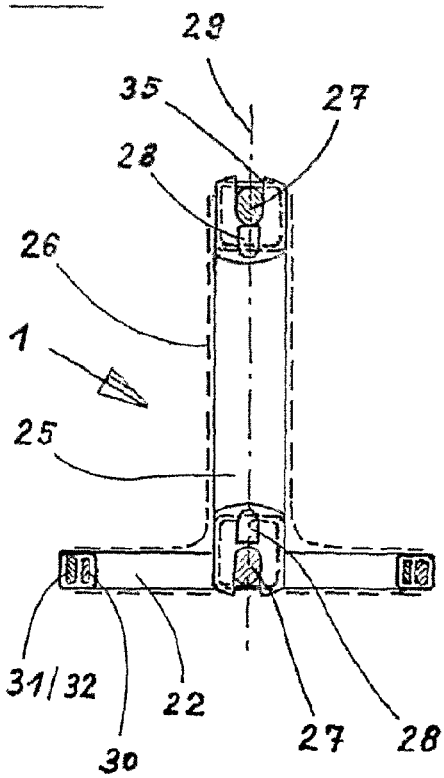
FIG. 5 shows a possible cross-section of a sail boom 1 according to the invention.

FIG. 5 shows a possible cross-section of a profile sail boom 1 according to the invention in an embodiment made of welded aluminium supporting structure parts 25 and an aerodynamically smooth outer cladding made of Faserplast 26 which serves as protection from contact by overlapping the moving joins between parts 41 (in FIG. 7) (shown by dot-dash line).

The lowermost and uppermost position of the upright-shaped pre-tensioned cords 27 which are surrounded with an elastic material can be seen, as well as the immediately adjoining position of the rocker edge bearings 28 made of hard metal for receiving the pretensioning forces (AT 504 0907 B1). All vertical tilt edge lines 29 run through the centre of the boom 1. Located at the ends of the transverse webs 22 of the aluminium construction parts 25 extending on both sides are the longitudinally displaceable cords 31, embedded in elastic slide guides 30 and made of sheathed Faserplast, of the deflection boundary 32 (AT 504 907 B1) (described in FIG. 7).

Figure 6:
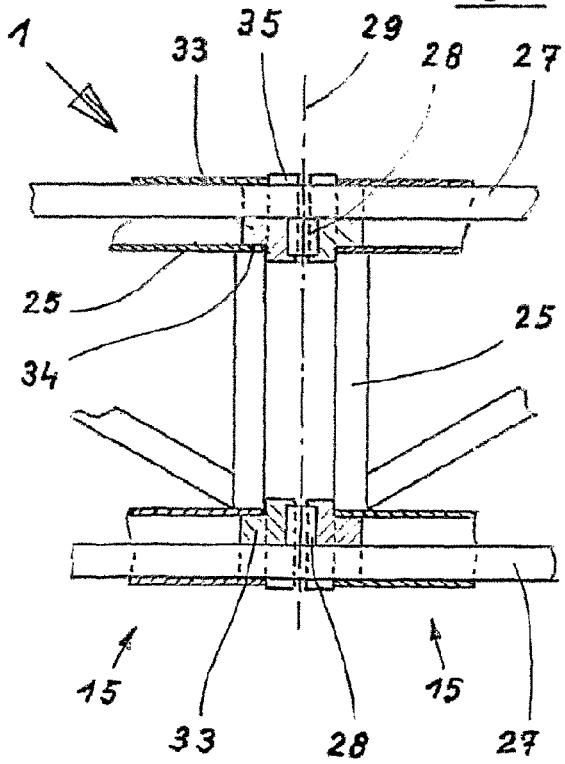
FIG. 6 shows a partially cutaway side view of the intermediate piece connection.

FIG. 6 shows a partially cutaway side view of two adjoining aluminium construction parts 25 of the intermediate partial pieces 15 of the profile sail boom 1 according to one embodiment of the invention.

A possible mirror-image structure of the aluminium construction parts 25 about the tilt axis 29 can be seen in which contact and mechanical support of the rocker bearings 28 takes place, which for their part are embedded in a pressure distribution piece 33 made of die cast aluminium, for example, which transmits compressive forces extensively to the aluminium construction parts 25 in which it is inserted with centering shoulders 34. Each pressure distribution piece 33 has an outwardly directed open recess 35 when assembled, in which the pretensioned cords 27 in the uppermost and lowermost position are centred at the centre of the profile sail boom 1 during final assembly and use.

FIG. 7 shows in plan view a profile sail boom 1 behind a mast 3 in a possible deflection curve according to the invention wherein the foot of the adjoining upwardly running batten mainsail 2 is guided and the cords 27 run in suitable connection via this dot-dash mid line.

It is possible to see the mast-side partial piece 13, the yardarm-side partial piece 14 and the intermediate pieces 15 of the same type of the profile sail boom 1, which is maximally deflected over the mid line which at the same time has the position of the cords 27.

The maximum deflection curve of the deflection boundary]]32 (in FIG. 5) is defined by the respectively outer cord 31 made, for example, of sheathed Faserplast, when the threaded spindle 36 firmly connected thereto is fully extended by means of its twistable adjusting nut 39 starting on both sides on the housing 39*a* of the partial piece 13 and the end terminal 37 at the other end of the longitudinally displaceable cord 31 inside the profile sail boom 1 has reached the guide eye 38 of the yardarm-side partial piece 14 as the end stop and the cord 31 comes under tension.

The inner luff-side cord 31*a* in the deflection curve on the other hand is free from tension so that its adjusting nut 39) can easily be readjusted by hand which promotes a preadjustment of the profile depth after the next turn. The resulting slack of the cord 31*a*) slides as overlength 40 through the guide eye 38 of the yardarm-side partial piece 14.

After the turn, the profile sail boom 1 takes on a mirror-inverted deflection whose deflection volume is determined by the lengthwise preadjusted cord 31*a* which now allows and limits the amount of deflection brought to tension in the outer curve.

(see AT 504 907 B1).

FIG. 8 shows a possible embodiment of a vertically stiff rocker bearing between two adjacent intermediate pieces 15 of a welded aluminium supporting structure of a profile sail boom 1.

The upper bearing structure inside the supporting upper strap 42 of the welded aluminium supporting structure parts 25 of the vertical bearing pair can be seen as an example in partial section. The appurtenant counterbearing located on the same tilt axis 29 in the lower strap (not shown) has a similar structure.

Located in the supporting upper strap 42 of the intermediate pieces 15 made for example of aluminium rectangular tube of the supporting structure 25 are a plurality of lamellar-like bearing eyes 43 which are alternately fastened in a suitable manner on the opposite upper strap 42 and a combined and centred by the common insertion bolt as bearing journal 44 made of hard abrasion-proof material.

Due to the number of mirror-inverted pulling or pushing lamellar eyes 43 made of suitable slidable material, the bearing journal 44 is multiply shear-stressed and can therefore advantageously be thinner, whereby the large forces which can be transferred by the multiple bearing can be introduced into the supporting straps 42 in a distributed and extensive manner, which saves weight.

Figure 9:
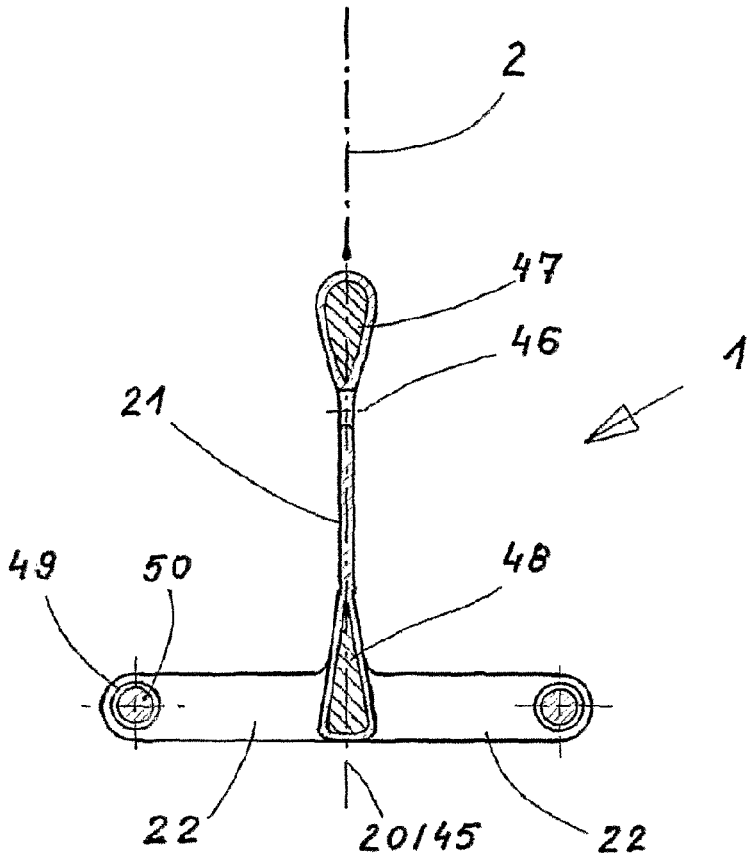
FIG. 9 shows a cross-section structure of a preferred sail boom 1.

FIG. 9 shows a cross-section structure of a preferred type of profile sail boom 1 according to the invention, the main structure being made of Faserplast. The symmetrical structure of the cross-sectional form 20 on both sides of the vertical mid line 45 of the supporting upright strut 21 which affords the vertical stiffness, with the transverse webs 922 extending on both sides at the lowermost point.

The batten mainsail 2—(shown by the dot-dash line) is then connected by means of marlines, for example, through several suitable openings 46 above the upright strut 21 approximately in the extension of the mid line 45. These openings 46 are used to fasten the reef marlines of the usual binding reef of the batten mainsail 2.

The necessary cohesion of the profile sail boom 1 is ensured by the upper cord 47 or the lower cord 48 made of a longitudinally directed high-strength fibre strand which is connected through the wall laminate of the upright strut 21 in suitable strength and flexibility with respect to shear force.

The transverse webs 22 laminated on both sides each have at their outer ends a laminated-in guide tube 49 which is penetrated by a cord 50 which is longitudinally displaceable therein, also made of a high tensile strength flexible Faserplast along the profile sail boom 1.

Figure 10:
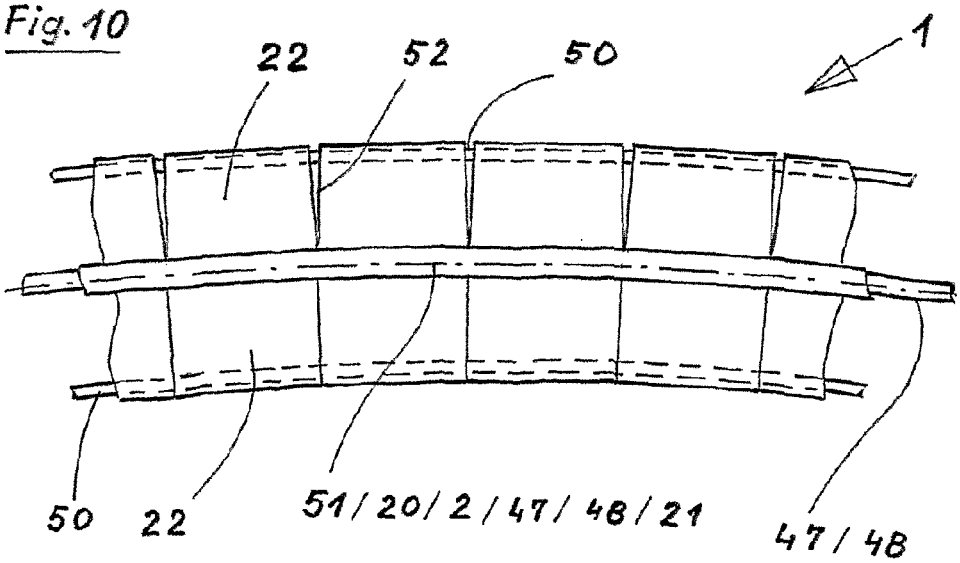
FIG. 10 shows a plan view of a section of the profile sail boom 1 according to FIG. 9.

FIG. 10 shows a plan view of a section of the profile sail boom 1 with the symmetrical cross-sectional shape 20 (acc. to FIG. 9) in a profile-defining curvature according to the invention for the sail 2.

The profile line of the sail 2, the mid position of the upper cord 47 and that of the lower cord 48 is shown by the dot-dash mid line 51 as the line of symmetry of the cross-sectional shape 20 (in FIG. 9). It is furthermore the mean of the curved upright strut 21 which is accordingly flexurally elastic as a result of the thin structure in this plane but transmits the shear forces of the upper cord 47 to the lower cord 48 in a flexurally rigid manner.

In order to allow and then be able to control desired horizontal bending, the moulded lateral transverse webs 22 with their guide tubes 49 are separated from one another at suitably short intervals by suitably wide continuous spacer joints 52 in order to allow the freedom of movement for the necessary horizontal bending on both sides of the continuous upright strut 21 with the lowest resistance but provide stiffness against twisting of the profile sail boom 1.

The distance of the spacer joints 52 from one another and their moderate spacing allows a maximum amount of curvature which is limited by impact of the joint wall on one another. Inside this region, the curvature is limited by means of the longitudinally displaceable cords 50 inside the guide tubes in the same way as is described in FIG. 7.

The invention claimed is:

1. A profile sail boom for a sail, in particular for a batten mainsail of a boat to be aerodynamically trimmed, which optionally has at least one head sail in front of a mast, comprising:

the profile sail boom including a thin upright-shaped vertical spar for mechanical coherence and for vertical bending stiffness with low horizontal resistance, from which at a lowermost point in an approximately 90° transverse position on both sides, a plurality of transverse webs separated by wedge-shaped spacer joints extend over a total length of the profile sail boom and guide surfaces and the profile sail boom has a symmetrical cross-sectional shape over the vertical mid line, wherein high-strength cords laminated-in at a lowermost and uppermost point of the spar run and guiding tubes laminated-in through the outer ends of the transverse webs are provided, through which longitudinally displaceable cords are guided.

2. The profile sail boom for a sail according to claim 1, wherein the high-strength cords laminated-in at the lowermost and uppermost position in the narrow spar with a longitudinally directed fibre structure have a concentrated cross-section towards the top and bottom.

3. The profile sail boom for a boat according to claim 1, wherein below the upper cord in the spar a plurality of recesses are provided for connection of the sail.

4. The profile sail boom for a boat according to claim 1, wherein the transverse webs as guide surfaces account for about 50% of the side surface of the spar.

5. The profile sail boom for a boat according to claim 1, wherein a supporting functional structure is comprised entirely of Faserplast.

* * * * *